United States Patent [19]

Moorhead

[11] 4,162,056

[45] Jul. 24, 1979

[54] PICTURE HANGING SYSTEM

[76] Inventor: Ritchie R. Moorhead, P.O. Box 6, Athens, Pa. 18810

[21] Appl. No.: 913,946

[22] Filed: Jun. 9, 1978

[51] Int. Cl.[2] ..... A47G 1/24

[52] U.S. Cl. ..... 248/495

[58] Field of Search ..... 248/110, 300, 301, 489, 248/492, 493, 494, 495

[56] References Cited

U.S. PATENT DOCUMENTS

| | | | |
|---|---|---|---|
| 371,665 | 10/1887 | Brinkerhoff | 248/301 X |
| 549,505 | 11/1895 | Eldridge | 248/489 |
| 861,814 | 7/1907 | Crain | 248/110 |
| 1,024,169 | 4/1912 | Andrews | 248/493 X |
| 2,384,478 | 9/1945 | Lapeyre | 248/493 X |
| 2,468,190 | 4/1949 | Friedheim | 248/300 X |
| 2,877,972 | 3/1959 | Sutton | 248/493 X |
| 3,923,278 | 12/1975 | Marcil | 248/301 |

FOREIGN PATENT DOCUMENTS

| | | | |
|---|---|---|---|
| 333983 | 8/1930 | United Kingdom | 248/489 |
| 658377 | 10/1951 | United Kingdom | 248/493 |

*Primary Examiner*—William H. Schultz

*Attorney, Agent, or Firm*—Dennison, Dennison, Meserole & Pollack

[57] ABSTRACT

A hanging and leveling system for wall hangings comprising a wall mountable bracket including laterally spaced outwardly projecting side flanges defining, at their upper ends, a pair of upwardly opening seats. Affixed to the rear face of the wall hanging, to each side of the vertical center line thereof, is a pair of vertically spaced screw eyes, the upper screw eyes being laterally aligned and above the center of gravity of the wall hanging, and the lower screw eyes being laterally aligned and below the center of gravity of the wall hanging. A suspension wire extends transversely across the wall hanging between the upper screw eyes, through the upper screw eyes, and down to the lower screw eyes whereat the opposite ends of the wire are tensioned and affixed. The intermediate portion of the wire, between the two upper screw eyes, engages within the laterally spaced upwardly opening seats of the bracket in a manner so as to, in conjunction with upper screw eyes, draw the upper portion of the wall hanging toward the wall.

5 Claims, 4 Drawing Figures

FIG. 1
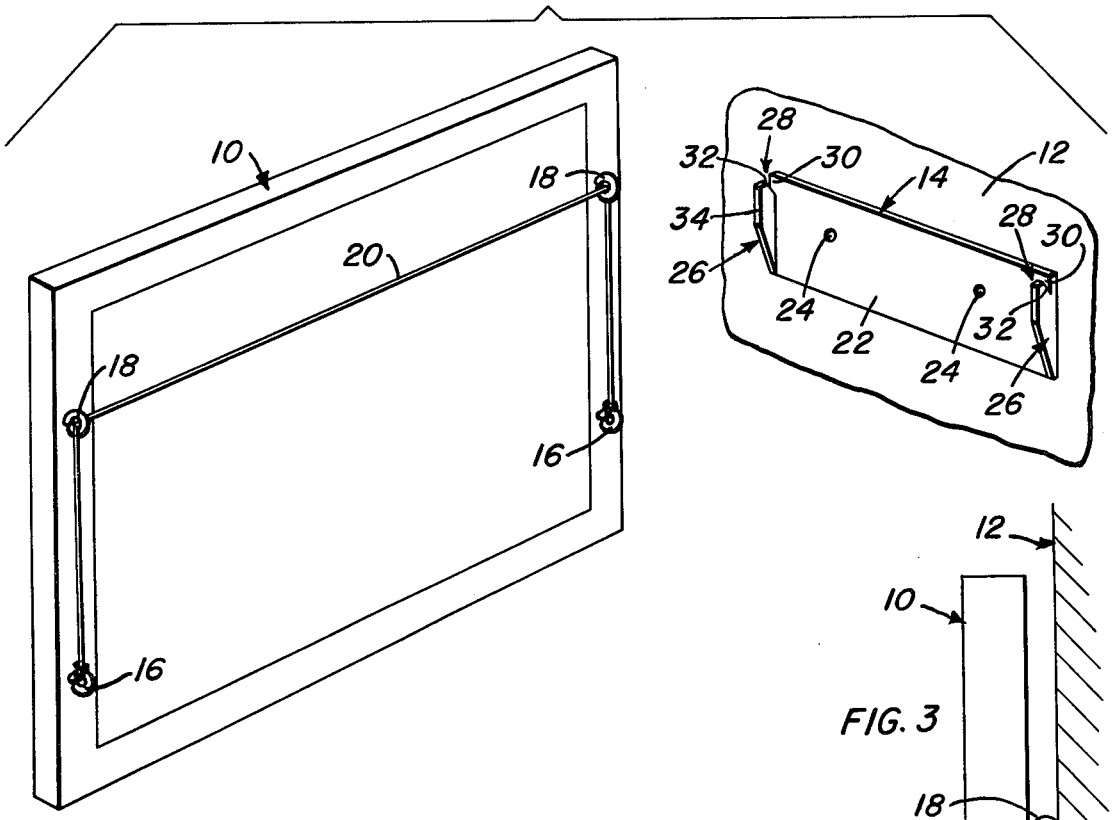
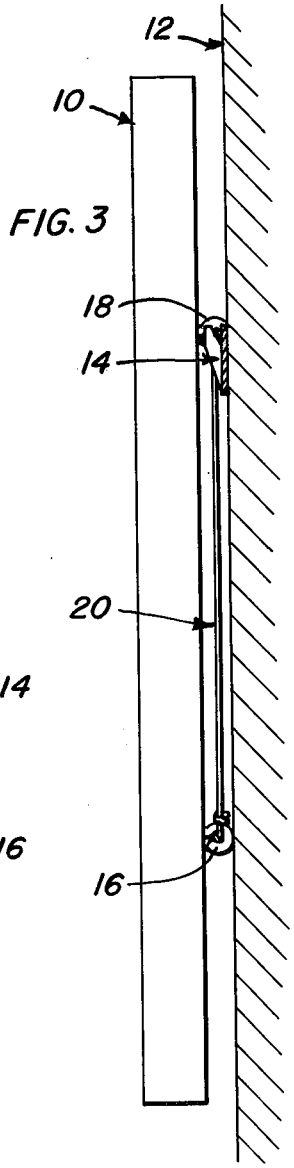
FIG. 3
FIG. 2
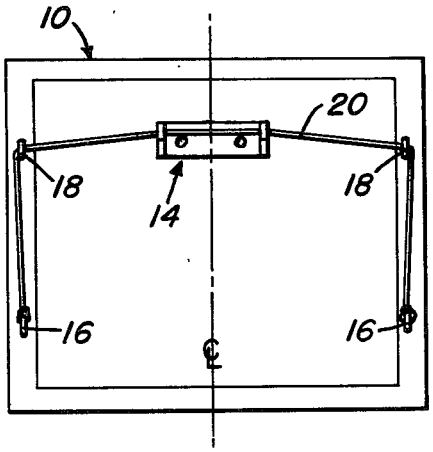
FIG. 4
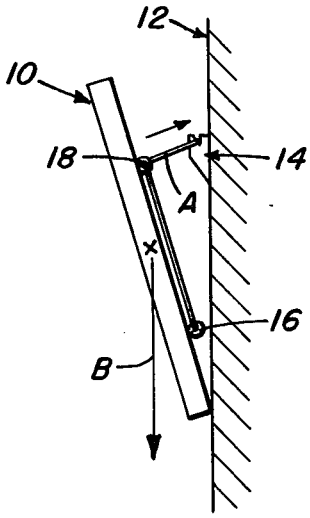

PICTURE HANGING SYSTEM

BACKGROUND OF THE INVENTION

The present invention is generally concerned with means for mounting wall hangings, normally pictures, and more particularly relates to a hanging system which insures, substantially automatically, both a level hanging or positioning of the picture, and an orientation of the picture substantially parallel to the wall.

Picture hanging, while basically a simple operation, has attendant problems with regard to maintaining a proper orientation of the suspended picture. Conventionally, a suspension wire has the opposite ends thereof secured to laterally spaced horizontally aligned points on the rear of a picture frame above the center of gravity thereof with the intermediate portion of the wire engaged over a wall mounted hook or nail. The picture, thus suspended, is not only prone to side slipping or tilting, but also, even when properly aligned, assuming a downwardly facing or angled orientation relative to the wall in view of the tendency for the upper portion of the picture to move outward relative to the wall while the lower edge of the picture engages against the wall.

Various means have heretofore been proposed in an effort to correct or eliminate one or the other of these two problems. In connection therewith, attention is directed to the following patents, constituting the most pertinent prior art known to Applicant:

U.S. Pat. Nos.:

549,505; Eldridge, Nov. 12, 1895;
994,511; Gross, June 6, 1911;
1,475,292; FitzGerald, Nov. 27, 1923;
2,384,478; Lapeyre, Sept. 11, 1945;
2,448,137; Cody, Aug. 30, 1948;
2,877,972; Sutton et al, Mar. 17, 1959;
3,384,987; Prechtl, May 28, 1968.

In each of these patents efforts have been made to improve upon the basic picture hanging procedure described above so as to achieve improved results, primarily in picture orientation.

SUMMARY OF THE INVENTION

The present invention contemplates a hanging system for wall hangings, such as pictures, which provides for a level suspension of the hanging, as well as a positioning of the hanging substantially parallel to the associated wall. This is effected utilizing a single flexible suspension wire or cord in conjunction with two steps of vertically spaced anchor and guide members affixed to the rear of the wall hanging, and a single wall mounted bracket providing a pair of laterally spaced wire receiving seats. The engagement of the wire, under tension, with both the upper and lower portions of the wall hanging, in conjunction with an inward drawing of the wire toward the wall by inwardly inclined edges on the bracket seats, and the downward load of the hanging on the wire, provides for a positioning of the wall hanging substantially parallel to the wall.

In more specifically defining the forces involved in bringing the wall hanging or picture toward a parallel orientation with the wall, it will be noted that the fixing of the opposed ends of the wire to the opposite sides of a picture frame below the center of gravity will, upon engagement of the wire with the bracket, and in the absence of the upper eyelets or guides, cause a substantial outward pivotting of the picture from the wall. As this occurs, the lower edge of the picture or the lower projecting wire receiving anchoring members will forcibly engage the wall, and the upper edge of the picture will be spaced substantially outward therefrom. This insures a snug engagement of the lower portion of the picture with the wall, and thus a substantial frictional resistance to any side slipping or the like. However, the outward angle of the picture relative to the wall clearly would not be acceptable.

The present invention proposes combining a firm frictional engagement between the lower portion of the picture and the wall with a substantially parallel orientation of the picture. This is achieved by running the wire through upper guide eyes and tensioning the wire therebetween. The intermediate portion of the wire between the two upper guides engages the spaced seats of the bracket with the full weight of the picture acting, under the force of gravity, to effect a straightening of the wire from the point of engagement with the bracket seats to the point of anchoring to the picture frame. The forces thus acting to straighten the wire will effect a slight downward shifting of the picture and a corresponding inward shifting of the upper portion of the picture and the guide members through which the wire passes. This inward shifting of the upper portion of the picture will continue until either the horizontal portion of the wire achieves a straight line, or until such time as the upper guide members or an abutment on the upper portion of the picture engage the wall and prevent further inward rotation thereof. What is thus achieved is both a positive or forceful frictional engagement of the picture, below the center of gravity, with the wall, and an inward drawing of the upper portion of the picture so as to achieve substantial parallelism with the wall. The enhanced frictional engagement of the lower portion of the picture with the wall is considered a significant factor in stabilizing the picture in position. This in turn cooperates with the laterally spaced dual seats provided by the bracket to the opposite sides of the center of gravity of the picture, which in itself provides a significant stabilizing effect on the picture.

With reference to the above cited prior art, it will be noted that the patent to FitzGerald, in FIG. 2, illustrates the normal inclination assumed by a wall suspended picture. The patent to Prechtl brings such a conventionally suspended picture to a generally parallel orientation with the wall by the addition of spacing pegs at the bottom of the frame in particular. These pegs act so as to resist the natural gravitational force tending to swing the lower end of the picture inward toward the wall. This is directly contrary to the present invention wherein parallelism is achieved by the action of the force of gravity on the picture acting so as to straighten the susepension wire.

DESCRIPTION OF THE DRAWINGS

FIG. 1 is an exploded perspective view illustrating the rear face of a wall hanging with the suspension wire mounted thereon, and the adjoining wall with the bracket mounted thereon, the bracket being enlarged for purposes of illustration;

FIG. 2 is a rear elevational view of the wall hanging or picture and illustrating the relationship of the bracket with the suspension wire;

FIG. 3 is a vertical cross sectional view through a wall mounted wall hanging utilizing the system of the present invention; and FIG. 4 is a schematic illustration of the forces involved in achieving the desired parallelism between the picture and the wall.

DESCRIPTION OF PREFERRED EMBODIMENT

Referring now more specifically to the drawings, reference numeral 10 is used to generally designate a wall hanging which, in most instances, will consist on a picture including both the visual display and the frame. The system of the present invention is specifically intended as a unique means for mounting the wall hanging or picture 10 on a wall 12.

In effecting the hanging of the picture 10 on the wall 12, the system of the present invention provides for an orientation and automatic retention of the picture both level on the wall and parallel thereto. The actual physical components of the system include a wall mounted bracket 14, two anchor members 16, two guide members 18 and an elongated flexible suspension member or hanging wire 20.

The bracket 14 includes a flat rectangular back panel 22 having a pair of spaced apertures 24 therethrough for receiving mounting screws or the like. At the opposite vertical edges of the back panel 22, the bracket 14 is provided with a pair of forwardly projecting full height flanges 26, each provided with a seat defining notch 28 in the upper end thereof. The back edge 30 of the notch is vertical, and normally defined by the forward face of the panel 22 itself. The front edge 32 of each notch 28 is inclined forwardly and upwardly from the lower edge of the rear notch 30 and terminates at the upper end of the corresponding flange 26 inward of the forward edge 34 of the flange. In this manner, reception of the hanging wire 20 within the notches 28 will, through the inclined forward edges 32, result in a sliding of the wire downwardly and rearwardly for a snug stable reception within the notch defined seats. If so desired, and as illustrated in the drawings, the forward edge 34 of each of the flanges 26 can extend vertically for approximately half the height thereof down from the upper end, at which point each of the forward edges 34 can taper inwardly to approximately the plane of the front face of the panel 22 at the lower edge thereof.

As an example of one typical bracket size, the back panel can be 1/16 inch thick, 4 inches wide and 1 inch high. Each flange will in turn be approximately 1/16 inch thick and project 3/16 inch outward from the front face of the panel with each notch, at the wide upper end thereof, being ⅛ inch across. The depth of the notch will be 3/16 inch. As will be appreciated, the size of the bracket will depend in large part on the size of the wall hanging to be mounted.

Attention is now directed to that portion of the picture hanging system which is secured to the rear face of the picture 10. In regard thereto, it will be noted that both the anchor members 16 and the guide members 18 have been illustrated as screw eyes. While other appropriate means can be used, screw eyes are preferred as the most convenient means for mounting the suspension wire 20. When a picture frame or the like is involved, the anchor members 16 and guide members 18 will preferably be mounted in opposed pairs in the vertical side rails of the frame. The anchor members 16 will be secured to the frame side rails at a point upward from the lower edge approximately one quarter of the height of the frame. The upper guide members 18 will in turn be secured to the frame downward from the upper edge approximately one quarter of the height. Positioned in this manner, on a conventional rectangular frame, it will be appreciated that the anchor members 16 are located below the center of gravity of the wall hanging 10 while the upper guide members 18 are located above the center of gravity.

The flexible suspension member or wire 20 is extended horizontally between the upper laterally aligned guide members 18 are freely therethrough or thereabout with the opposite end portions of the wire 20 extending vertically downward and tightly anchored to the two anchor members 16 in a manner whereby substantial tension is applied to the wire 20 so as to maintain the intermediate horizontal portion thereof as straight as possible under load conditions. It is this horizontal intermediate portion of the wire 20 which is received within the notch formed seats 28 of the bracket 14 with, as will be best appreciated from FIG. 2, one seat 28 being located to each side of the vertical center line of the wall hanging 10. In this manner, a substantial degree of stability is introduced into the wall hanging 10 in that any accidental raising or upward tilting of one side of the hanging 10 will require rotation about the seat in the remote flange with the major portion of the hanging being on that side of the point of rotation which is being elevated. As such, there will be a substantial downward force tending to automatically restore the hanging to its level position supported within both seats. In other words, and with reference to FIG. 2 in particular, were the left hand side of the hanging 10 accidentally raised or tilted upward, the suspension wire 20 would lift out of the left hand seat and pivot about the right hand seat. In this position, it will be appreciated that the major portion of the weight of the picture would be to the left of the right hand seat. Thus, upon removal of the tilting force, the heavier raised side of the hanging would fall downwardly so as to reposition the wire within the left hand seat. Thus, in order to realize the full potential of the bracket, it will be appreciated that the seats are to be located to the opposite sides of the center line or center of gravity of the hanging, and preferably spaced to the same extent on both sides thereof.

Turning now to the extension of the hanging wire 20 through upward guides prior to engagement with the lower anchor members, the specific purpose for this arrangement is to achieve a vertical, or as nearly vertical as possible, orientation for the wall hanging with the wall hanging ideally paralleling the face of the wall 12 on which it is mounted. In a normally suspended picture, the lower edge of the picture will firmly engage against the wall with the upper edge of the picture outwardly tilting therefrom. As the points of engagement of the conventional suspension wire with the hanging move downwardly toward the lower edge of the frame, a greater tilting is experienced, along with a greater frictional engagement of the lower end of the frame with the wall. The present invention proposes a mounting of the hanging in a manner whereby a substantial inward pressure is exerted toward retaining the lower portion of the wall hanging against the wall, in conjunction with an inward retention of the upper portion of the hanging to a position which is or very closely approaches parallelism with the wall. This is effected by projecting the suspension wire 20 through the upper guides 18 prior to engagement with the wall bracket 14, rather than extending the wire directly from the lower anchors 16 to the bracket. In mounting the wire 20 in this manner, the weight of the hanging itself tends to position the hanging in the manner desired.

In further explanation attention, is directed to FIG. 4 wherein the concepts and forces involved have been schematically illustrated. In this Figure, the intermediate portion of the wire, designated by letter "A," which extends between the guides 18 and engages the bracket 14, has been elongated from its normally taut condition for purposes of illustration. Further, the picture or wall hanging 10 has been illustrated in a tilted position which would be assumed were the wire extended directly between the bracket 14 and the bottom anchors 16. However, by extending the wire through the guides 18 prior to an engagement over the bracket 14, and as the guides 18 are above the center of gravity of the hanging 10, generally designated by the arrow "B," the weight of the wall hanging 10 is directly translated into a force, through the lower anchored ends of the wire 20, which acts in a direction so as to reduce the length of the wire and hence draw the intermediate portion "A" of the wire as close as possible to the bracket 14. In this manner and as indicated by the arrow overlying the intermediate portion "A" of the wire, the upper end of the wall hanging 10 is drawn toward the wall while still retaining a substantial inwardly directed force at the anchored lower ends of the wire.

FIG. 3 illustrates the wall hanging in its final automatically assumed position with the upper end of the wall hanging drawn inwardly until such time as there is no lateral deflection of the intermediate portion of the wire 20 or an upper portion of the frame, or the guides, abut against the wall. Alternatively, the inward drawing of the upper end of the picture may be limited by engagement with the bracket flanges. In the illustrated embodiment, complete parallelism with the wall is assured by projecting the upper guides 18 an equal distance with the lower anchors 16 at a distance slightly greater than the full depth of the bracket 14. This inward drawing of the upper end of the wall hanging 10 is effected while still retaining a forceable inward drawing of the lower end of the wall hanging 10, which in turn produces a frictional engagement with the wall whereby any side slipping or tilting, relative to the bracket 14, is resisted.

From the foregoing, it will be appreciated that a picture hanging or leveling system has been devised wherein the weight of the picture itself contributes significantly toward both retaining the picture against side tipping, or restoring the level of the picture subsequent to an accidental tipping or movement thereof, and automatically effecting a positioning of the picture so as to substantially parallel the supporting wall surface. As indicated previously, the size of the bracket can vary in accordance with the size of the picture or wall hanging to be supported thereon. Further, if considered necessary, two brackets can be utilized to effect the desired support, one bracket to each side of the vertical center line of the wall hanging.

I claim:

1. In a hanging system for a wall hanging; a wall hanging, a flexible suspension member, a wall mount for receiving a horizontal intermediate section of the flexible suspension member and supporting said suspension member, and means on the wall hanging to mount said suspension member, said means comprising a pair of anchor members fixed to the wall hanging to the opposite sides of and below the center of gravity of the wall hanging, and a pair of guide members fixed to the wall hanging vertically above and aligned with the anchor members, said flexible susupension member having the opposite ends thereof fixed to the anchor members, said suspension member extending from one anchor member vertically about the guide member thereabove, horizontally across to the second guide member and vertically to the second anchor member therebelow, said intermediate section of the flexible suspension member comprising that section between the guide members, said intermediate section being tensioned between the guide members independently of said wall mount.

2. The hanging system of claim 1 wherein said wall mount comprises a bracket having a pair of laterally spaced upwardly opening seats, said upwardly opening seats engaging said intermediate section to the opposite sides of the center of gravity of the wall hanging.

3. The hanging system of claim 2 wherein the wall mount bracket comprises a flat panel having an outer face and an inner face positionable against the wall, and a pair laterally spaced flanges on said panel, said flanges projecting an equal distance outwardly from the outer face of said panel and having equal height upper ends, said upwardly opening seats being defined on the upper ends of said flanges.

4. The hanging system of claim 3 wherein each seat comprises an upwardly opening notch defined by a first edge generally coplanar with the outer face of the flat panel, and a straight second edge extending, from the lower end of the first edge, upwardly and outwardly to the upper end of the flange.

5. The hanging system of claim 4 wherein said anchor members and said guide members are each of a projecting length generally equal to the thickness of the bracket, including the flanges.

* * * * *